United States Patent [19]

Nakagawa et al.

[11] 4,204,486

[45] May 27, 1980

[54] COOLING SYSTEM FOR V-SHAPED, FORCED AIR-COOLED ENGINE

[75] Inventors: Itsusuke Nakagawa; Tokuichi Aoyama, both of Sakaishi, Japan

[73] Assignee: Kubota Ltd., Osaka, Japan

[21] Appl. No.: 893,691

[22] Filed: Apr. 5, 1978

[30] Foreign Application Priority Data

Jun. 30, 1977 [JP] Japan ..... 52/87426[U]

[51] Int. Cl.[2] ..... F02F 1/34

[52] U.S. Cl. ..... 123/41.6; 123/41.61; 123/41.62; 123/41.65; 123/41.7; 123/41.74

[58] Field of Search ..... 123/41.6, 41.61, 41.62, 123/41.65, 41.67, 41.7, 41.74, 55 VF, 55 VS, 55 VE, 55 V, 41.28

[56] References Cited

U.S. PATENT DOCUMENTS

| | | | |
|---|---|---|---|
| 1,624,453 | 4/1927 | Wilkinson | 123/41.62 |
| 2,082,869 | 6/1937 | Brown | 123/41.62 |
| 2,267,423 | 12/1941 | Reimspiess | 123/41.61 |
| 2,585,083 | 2/1952 | Bouvy | 123/41.62 |
| 3,236,215 | 2/1966 | Eck et al. | 123/41.6 |
| 4,134,370 | 1/1979 | Iwahashi et al. | 123/41.65 |

FOREIGN PATENT DOCUMENTS

| | | | |
|---|---|---|---|
| 44121 | 10/1934 | France | 123/41.62 |
| 407675 | 3/1934 | United Kingdom | 123/41.61 |

*Primary Examiner*—Charles J. Myhre
*Assistant Examiner*—Jeffrey L. Yates
*Attorney, Agent, or Firm*—Schwartz, Jeffery, Schwaab, Mack, Blumenthal & Koch

[57] ABSTRACT

A V-shaped, forced air-cooled engine includes a radial flow cooling fan mounted in front of the crankcase, within a housing containing air passageways leading to the cylinders on the opposite sides of the engine. The air passageways are constructed so as to assure the same amount of cooling air intake for each cylinder, the threshold areas of each passageway being provided with rounded surfaces shaped so as to assure a minimum of hissing sound and other noise caused by the moving, intake airstream.

5 Claims, 6 Drawing Figures

COOLING SYSTEM FOR V-SHAPED, FORCED AIR-COOLED ENGINE

BACKGROUND OF THE INVENTION

1. Field of the Invention

The present invention relates generally to cooling systems for V-shaped, forced air-cooled internal combustion engines, of the type employing a radial flow cooling fan mounted on the front of the crankcase. More particularly, it relates to an improved arrangement for the cooling air passageways in such an air-cooled engine, whereby the same amount of cooling air is supplied to the cylinders on opposite sides of the engine, with a minimum of attendant noise caused by the flowing airstream.

2. Description of the Prior Art

While in theory offering several advantages, radial flow cooling fans have not heretofore found acceptance as a means to supply a flow of cooling air to the cylinders of a V-shaped forced air-cooled engine. This has been primarily because of the difficulty in arranging the radial fan and the cooling air passageways so that the engine's cylinders will be cooled equally and sufficiently by the airstream. In addition, where efforts have been made to design cooling air passageway arrangements that can properly divide the flow of cooling air, the flowing airstream has generated levels of noise that are unacceptable for normal conditions of use.

Because of these difficulties, it is now common practice to supply cooling air to such engines by a conventional fan, arranged to direct a flow of air axially rearwardly over the engine. While this arrangement provides good air distribution, the resultant structure is usually unduly large and complicated.

There is thus need for an improved arrangement for providing cooling air to a V-shaped, forced air-cooled engine by use of a radial cooling fan, wherein the flow of air to the cylinders mounted on the two sides of the engine will be even, and resultant levels of noise caused by the moving airstream will be within acceptable limits. The present invention is intended to satisfy that need.

SUMMARY OF THE INVENTION

In the arrangement of the invention a radial cooling fan is mounted on the front of the engine crankcase, and is enclosed within a housing containing cooling air passageways shaped and positioned to direct equal and sufficient quantities of cooling air to the cylinders on the opposite sides of the engine. The passageways are defined by threshold areas spaced evenly about the radial cooling fan to achieve the desired evenness of airflow.

The threshold areas of the passageways are specially shaped so that the flow of cooling air thereover will not generate unacceptable levels of noise. Specifically, it has been found that by rounding these threshold areas so that the included angle of the walls defined thereby is generally obtuse as opposed to being sharply acute, airflow-generated noise can be held to well within acceptable levels.

It is the principal object of the present invention to provide an arrngement for utilizing a radial cooling fan to provide cooling air to the cylinders of a V-shaped, forced air-cooled engine, whereby the cooling air is evenly provided in sufficient quantities to the opposite sides of the engine, within noise levels that are acceptable to the average user.

Other objects and many of the attendant advantages of the present invention will become readily apparent from the following Description of the Preferred Embodiment when taken in conjunction with the accompanying drawings.

DESCRIPTION OF THE PREFERRED EMBODIMENT

Figure 4:
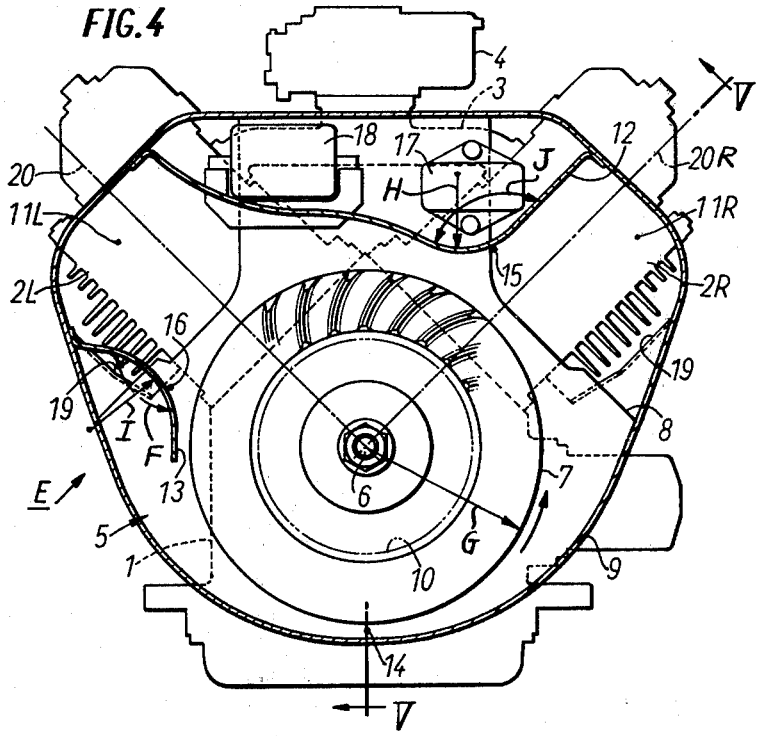
FIG. 4 is a vertical cross-sectional view through the cooling system arrangement of the preferred embodiment of the present invention, showing in particular the unique configuration of the threshold areas of the cooling air passageways.
Figure 5:
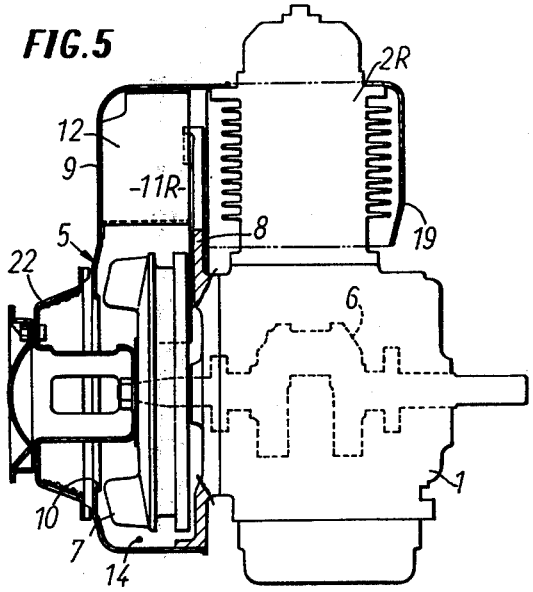
FIG. 5 is a vertical cross-sectional view taken along the line V—V in FIG. 4 and further showing the construction of the present cooling air passageway arrangement.

In order to better understand the features of the preferred embodiment of the invention as shown in FIGS. 4 and 5, a discussion of the prior art and of early experimentation in connection with the present invention is helpful.

Figure 1:
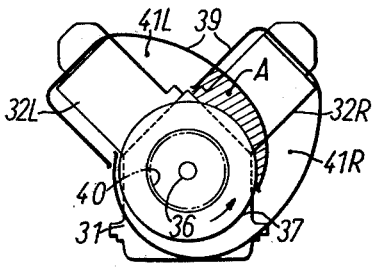
PRIOR ART FIG.1
FIGS. 1 and 2 are vertical cross-sectional views showing prior art cooling system arrangements for V-shaped, forced air-cooled engines, over which the present invention is an improvement.

Referring first to FIG. 1, there is shown a V-shaped, forced air-cooled engine from the prior art, wherein a radial flow cooling fan 37 is mounted in front of the engine crankcase 31 on the engine crankshaft 36. The radial fan 37 gathers cooling air from outside the engine through an inlet port 40 and forces it to flow through a fan case or housing 39 toward a right-hand cylinder 32R and a left-hand cylinder 32L. The cooling airflow is conducted to the right-hand and left-hand cylinders 32R and 32L via passageways 41R and 41L, respectively, the passageway 41R receiving cooling air from the lower part of the radial fan 37, and the passageway 41L receiving it from the upper part of the fan.

One advantage of the arrangement shown in FIG. 1 is that a considerable amount of cooling air can be taken in by the radial fan 37 for passing over the cylinders on the opposite sides of the engine. However, the arrangement also has a significant disadvantage because of the narrowing of the inlet port for the right-hand cooling air passageway 41R under the shade of the left-hand air passageway 41L, as is indicated in FIG. 1 by the shading at A, which narrowing leads to an unequal distribution of the cooling air into the two passageways 41L and 41R. This unequal distribution of the cooling airflow in turn results in unequal cooling of the cylinders 32L and 32R, an unacceptable condition under normal operating circumstances.

Figure 2:
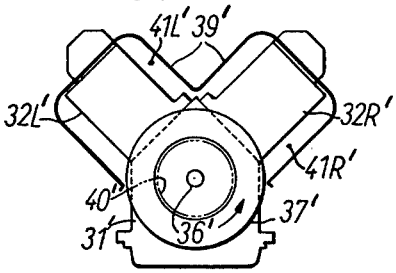
PRIOR ART FIG.2

An alternative arrangement proposed to overcome the unequal cooling problem of the arrangement of FIG. 1 is shown in FIG. 2, which shows an engine crankcase 31' having a crankshaft 36' on which a radial cooling fan 37 is mounted, the engine including right-hand and left-hand cylinders 32R' and 32L'. A modified housing 39' is utilized in FIG. 2 and includes right-hand and left-hand passageways 41R' and 41L' that are designed to have much smaller intake areas, as opposed to the arrangement of FIG. 1. While the narrowed intakes even out the flow of cooling air to the opposite sides of the engine, they also significantly reduce the total flow of cooling air so as to tend to cause an overheating problem. Thus, the advantage of equal cooling is traded off against the disadvantage of insufficient cooling for proper engine operation.

Figure 3:
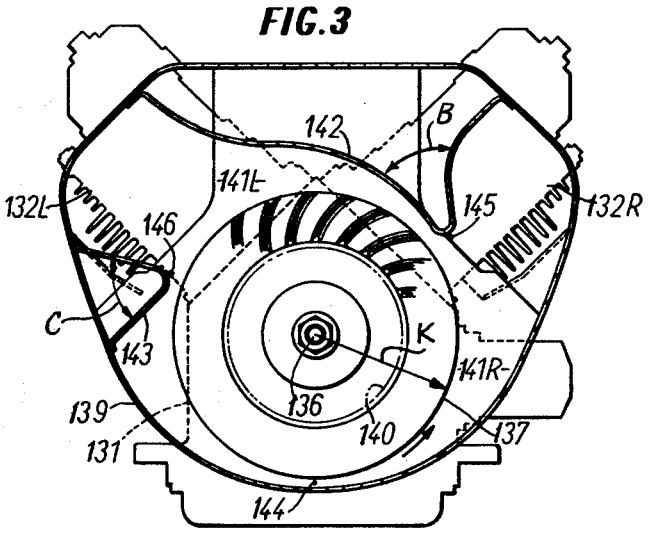
FIG. 3 is a vertical cross-sectional view through an early, experimental embodiment of the present invention, showing a cooling air passageway arrangement that is effective to evenly divide the flow of cooling air to the opposite sides of the engine.

Referring now to FIG. 3, there is shown an early, experimental embodiment of the present invention designed to provide both an even airflow to the cylinders on opposite sides of the engine and an airflow sufficient to cool the cylinders satisfactorily. This embodiment was generally illustrated in copending U.S. patent applications Ser. Nos. 785,831 and 788,881, filed on Apr. 8, 1977 and Apr. 19, 1977, respectively, and both owned by the same assignee as this application. The embodiment of FIG. 3 suffers from the disadvantage that the cooling airstream generates an unacceptable level of noise as it flows through the housing.

In FIG. 3, an engine crankcase is shown at 131 and includes a crankshaft 136 on which a radial cooling fan 137 is mounted. The engine includes right-hand and left-hand cylinders 132R and 132L, respectively, which are both covered by a single fan casing or housing 139. The interior of the housing 139 is divided into a right-hand cooling air passageway 141R and a left-hand cooling air passageway 141L by partition plates 142 and 143, respectively.

The partition plate 142 has a sharply acute bending turn therein which defines a threshold area on which is located a threshold point 145 for the air passageway 141L. The included angle B formed by the threshold area walls at the threshold point 145 is sharply acute, as is apparent from FIG. 3. In the same manner, the partition plate 143 has a bend therein forming a threshold area upon which is located a threshold point 146, and the walls of this threshold area also form a sharply acute included angle C. It is also immediately apparent from FIG. 3 that the threshold areas in the regions of the threshold points 145 and 146 take the form of projections, protrusions or nubs. The angle C being larger than the angle B, however. Typically, the angles B and C will measure about 35° and about 60°, respectively, and the respective radii of curvature will be about 7 mm and about 10 mm, when the radius K of the cooling fan 137 is about 125 mm. A further threshold point 144 is located underneath the radial fan 137, between it and the cover 139. Thus, the inlet ports of the passageways 141R and 141L are defined by the three threshold points 144, 145 and 146, with the circumferential widths of the two inlet ports being designed so as to be substantially equal in length.

The arrangement of FIG. 3 provides relatively elongated, large air inlet openings for the passageways 141R and 141L, as compared with those shown in the arrangement of FIG. 2. This increases the amount of cooling air that is taken into the passageways and assures that the cylinders 132R and 132L will be cooled satisfactorily. Because the passageways 141R and 141L are of equal size and shape, moreover, the cooling will be even on both sides of the engine. Thus, the cooling problems of the prior art are overcome. However, it has been found that the flow of cooling air in the arrangement of FIG. 3 causes a serious noise problem, particularly on the sharply acutely curved threshold areas carrying the points 145 and 146. Specifically, the airflow causes a hissing sound at relatively high frequencies, which is unpleasant to hear and which strikes the nerves of any person nearby.

Turning now to the preferred embodiment of FIGS. 4 and 5, such is designed to solve the noise problem associated with the arrangement of FIG. 3, without impairing the cooling efficiency obtainable from the arrangement. Thus, it provides an improved cooling system for use in a V-shaped, forced air-cooled engine, based on a radial flow cooling fan, and which assures that the cylinders on both sides of the engine will be equally and adequately cooled with no accompanying noise problem. The principal difference between the embodiment of FIG. 3 and the embodiment of FIGS. 4 and 5 is that in the latter embodiment, the threshold areas carrying the threshold points are formed to be generally obtuse or rounded, unlike the sharply acute threshold areas of FIG. 3. This difference has been found to alleviate the noise problem, as will be explained.

Referring now to FIGS. 4 and 5, the V-shaped engine of the invention is indicated generally at E and includes a substantially pentagonal crankcase 1 having right-hand and left-hand cylinders 2R and 2L arranged in V-form thereon, the respective longitudinal axes of said cylinders being indicated at 20R and 20L. An air-and-gas mixture inlet pipe 3 is located to extend between the cylinders 2R and 2L, and a carburetor 4 is mounted thereabove. The engine E includes a crankshaft 6, the forward end of which projects from the crankcase 1.

The cooling system arrangement of the invention is indicated generally at 5 and is mounted on the front of the engine E. It includes a radial flow cooling fan 7 coupled to the forward end of the crankshaft 6, which functions as both a cooling fan and a flywheel. A mounting bracket 8 is positioned between the crankcase 1 and the cooling fan 7 and functions also as a gearcase cover.

A fan case or housing 9 is fastened to the bracket 8 and covers or extends over both of the cylinders 2R and 2L, as well as over the cooling fan 7, all as shown in the drawings. The fan housing 9 is provided with an inlet port 10 in the lower part of its front face, centered on the axis of the crankshaft 6, as best shown in FIG. 5. The inlet port 10 is covered by an anti-dust cover 22, designed to admit filtered cooling air therethrough into the housing 9.

The radial flow cooling fan 7 is rotated in the counterclockwise direction as shown in FIG. 4, and cooling air is delivered from the right-hand periphery of the fan to the right-hand cylinder 2R via a right-hand passageway 11R, which will be described in more detail. Similarly, the cooling air blown from the left-hand periphery of the cooling fan is delivered to the left-hand cylinder 2L via a passageway 11L, which will also be further described.

The first, right-hand passageway 11R is defined on its lower side by a portion of the fan housing 9 that extends from the center of the bottom of the fan housing upwardly to the right-hand shoulder portion thereof, and on its upper side by a portion of an upper partition plate 12 that is mounted within the housing 9 above the radial cooling fan 7. The second, left-hand passageway 11L is defined by another portion of the upper partition plate 12, the left-hand shoulder portion of the fan housing 9 and a lower partition plate 13 mounted within the casing 9 to the left of the radial cooling fan 7.

The boundaries of the passageways 11R and 11L are respectively defined by threshold points 14, 15 and 16. The threshold point 14 is provided under the radial cooling fan 7, while the threshold point 15 is located on the right-hand curved, rounded threshold area of the upper partition plate 12. Finally, the threshold point 16 is provided on the curved, rounded threshold area of the lower partition plate 13. The entrance to the first, right-hand passageway 11R is thus defined as extending between the threshold points 14 and 15, while the entrance to the second, left-hand passageway 11L is defined by the threshold points 15 and 16.

More specifically, the threshold points 14, 15 and 16 are determined and arranged as follows:

First of all, the threshold point 16 is set on its threshold area by taking into consideration the location of the left side wall of the left-hand cylinder 2L and the direction of the airstream produced by the rotating fan 7. With the threshold point 16 set at this location, the threshold point 15 is then set on its threshold area at a point on the left side wall of the right-hand cylinder 2R, but slightly biased towards the longitudinal axis 20R of said cylinder. Finally, the third threshold point 14 is set on the bottom wall of the housing 9 at a point under the radial cooling fan 7, chosen so that the angle formed by lines extending from the threshold point 15 to the center of rotation of the cooling fan 7, and then to the point 14 itself is substantially the same as the angle formed by a line extending from the threshold point 15 to the center of rotation of the fan 7, and then to the threshold point 16.

The passageways 11R and 11L are thus constructed to be identical in both shape and length, thereby assuring that the same amount of cooling air is taken into each of the passageways while the cooling fan 7 is rotating. The relatively large cooling air intake openings present between the threshold points 16 and 15, and between the threshold points 14 and 15, assure that a large quantity of air can be taken in, ensuring a cooling efficiency such that both cylinders 2R and 2L are cooled sufficiently and evenly.

The region defined between the threshold points 14 and 16 and the periphery of the radial cooling fan 7 is narrowed by the lower portion of the partition plate 13 and the lower, left-hand portion of the fan housing 9, so that a flow of cooling air will not be generated from this area.

Returning again to the threshold areas at the threshold points 15 and 16, it is noted that they are rounded and generally obtuse, as opposed to the sharply acute threshold areas in FIG. 3. In this regard, it will be immediately apparent from FIG. 4 that the threshold wall areas in the regions of the threshold points are free of any protuberances, projections, nubs or sharply bending turns, which of course is unlike the threshold areas in FIG. 3. The included angle F formed by extensions of the rounded wall on which the threshold point 16 is located will be about 92° or somewhat greater, whereby the rounded generally obtuse shape of the threshold area is attained, and the same is true for the included angle J formed by extensions of the rounded wall carrying the threshold point 15, the angle J measuring about 115°. By thus shaping these threshold areas as rounded or slow curves, the problem of noise associated with the flow of cooling air is immensely reduced as compared with the embodiment of FIG. 3, wherein the corresponding threshold areas are sharply acute. Typically, for an assembly wherein the radius G of the radial cooling fan 7 would be about 125 mm, the radii of curvature H and I for the threshold points 15 and 16 will be about 40 mm and about 55 mm, respectively.

In order to compare the advantages of the construction of FIGS. 4 and 5 over the embodiment of FIG. 3, experimental tests were conducted. In these tests, a fan housing corresponding to the configuration shown for the housing 139 in FIG. 3 and one corresponding to the fan housing 9 were alternately mounted on the same engine E, so that comparative measures of the cooling air intake, the extent and balance of the cooling of the cylinders, the temperatures attained and the noise generated by the flowing air could all be obtained. To measure the noise, a microphone was placed 30 cm behind the right-hand cylinder 2R of FIG. 4, with an angular displacement of 45° against the center of the crankshaft 6.

Figure 6:
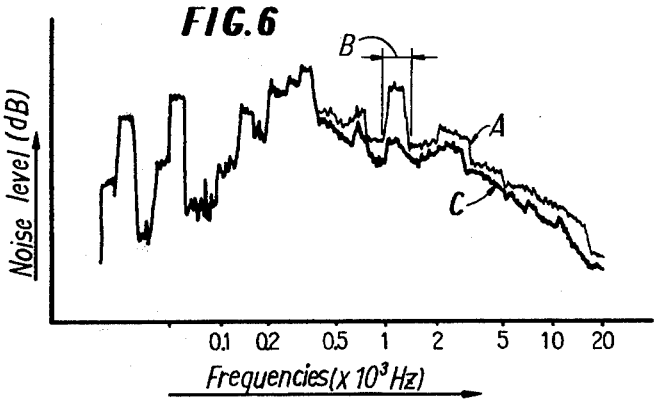
FIG. 6 is a diagram showing the relationship between frequency and noise as related to a particular experimental comparison between an engine constructed according to FIG. 3 and an engine constructed according to FIG. 4.

The results of these comparative tests were as follows:

(1) There was no substantial difference in the amount of cooling air sent to the right-hand and the left-hand cylinders for each of the two housings, and between the two embodiments. The surface temperatures of the two cylinders for the two embodiments showed no substantial differences in the tests, and it was found that these surface temperatures were at an acceptable low level;

(2) Referring to FIG. 6, it was found that noise levels using the two different housings 39 and 9 showed no difference in the range of low frequencies. But as the frequency levels became higher, the differences tended to enlarge by a few decibels.

In the diagram or graph of FIG. 6, the noise curve A corresponds to tests with the embodiment of FIG. 3, and the noise curve C corresponds to tests with the embodiment of FIGS. 4 and 5. Note that the noise curve A rises abruptly in the noise level zone designated at B, in the range of about 1000 Hz to about 1600 Hz. On the other hand, the noise curve C generated from the preferred embodiment has no such abrupt rise in this same zone B. In addition, the curve C indicates that the noise level tends to lower from 300 Hz and upwards. When this favorable result is considered in terms of a human acoustic characteristic curve, it will be understood that the noises produced by the engine E when equipped with the fan housing 9 of FIGS. 4 and 5 as a whole is reduced to a neglible level as measured by the human senses, particularly because of the reduction in noise level in the high audiofrequencies of 500 Hz to 5000 Hz.

In the course of conducting the noted comparison tests, the radii of the threshold areas were variously changed. It was found that for so long as the threshold areas were sharply acute, especially with a radius of about 15 mm or less, the generation of the hissing noise cannot be avoided.

Returning again to the preferred embodiment of FIGS. 4 and 5, such can be modified by prolonging the lower partition plate 13, so that it extends along the outer periphery of the cooling fan 7 in closely spaced relationship, up to a point adjacent to the threshold point 14.

In FIGS. 4 and 5, the engine E also includes a CDI (Condenser Discharge Ignition system) unit 17 mounted adjacent to an ignition coil 18 in a space located between the upper partition plate 12 and the fan housing 9, the CDI unit 17 and the coil 18 being fastened to the bracket 8.

Obviously, modifications and variations of the invention are possible.

What is claimed is:

1. A cooling system for a V-shaped, forced air-cooled engine, said engine including a crankcase, and first and second cylinders mounted in V form on top of the opposite sides of said crankcase, said cooling system including:

a radial flow cooling fan mounted on the front of said crankcase, and driven by said engine to rotate in a direction from said second cylinder toward said first cylinder;

a fan housing covering said fan and at least the front portions of said cylinders, said housing including first and second cooling air passageways arranged to pass cooling air from said fan to said first and second cylinders, respectively;

means within said housing defining a first threshold wall area at the downstream side of the first passageway, and a second threshold wall area at the downstream side of said second passageway;

said first passageway having a first threshold point disposed on said first threshold wall area generally in line with the downstream side of said first cylinder, said second passageway having a second threshold point disposed on said second threshold wall area generally in line with the downstream side of said second cylinder but slightly biased towards said fan, a third threshold point being disposed under said fan, the angle measured between a first line extending from said first threshold point and the center of said fan and a second line extending from the center of said fan to said second threshold point being substantially the same as the angle measured between said second line and a third line extending from said center of said fan to said third threshold point; and said first and said second threshold wall areas, in the regions of the threshold points, being rounded, slow curves, being generally obtuse and being free of any protuberances, projections, nubs or sharply bending turns.

2. A cooling system as claimed in claim 1, wherein the radii of curvature of said first and said second threshold wall areas are greater than 15 mm.

3. A cooling system as claimed in claim 1, wherein said cooling fan is mounted on the crankshaft of said engine, and also functions as a flywheel.

4. A cooling system as claimed in claim 1, wherein said first threshold wall area is formed by a first partition mounted within said casing, and said second threshold wall area is formed by a second partition, also mounted within said casing, said first passageway being defined on its downstream side by a portion of said first partition and on its upstream side by a portion of said second partition, and said second passageway being defined on its downstream side by another portion of said second partition, and on its upstream side by a portion of the wall of said casing, said passageways being arranged to equally divide the flow of cooling air to the opposite sides of said engine.

5. A cooling system as claimed in claim 1, wherein the radii of curvature of said first and said second threshold wall areas are about 55 mm and about 40 mm, respectively.

* * * * *